US008464455B2

(12) United States Patent
Kallio

(10) Patent No.: US 8,464,455 B2
(45) Date of Patent: Jun. 18, 2013

(54) LOCKABLE SAFETY FOR FIREARM

(75) Inventor: Robert A. Kallio, Conesus, NY (US)

(73) Assignee: Sturm, Ruger & Company, Inc.

( * ) Notice: Subject to any disclaimer, the term of this patent is extended or adjusted under 35 U.S.C. 154(b) by 166 days.

(21) Appl. No.: 12/986,282

(22) Filed: Jan. 7, 2011

(65) Prior Publication Data

US 2012/0174454 A1 Jul. 12, 2012

(51) Int. Cl.
*F41A 17/02* (2006.01)
*F41A 17/46* (2006.01)

(52) U.S. Cl.
USPC ..... 42/70.06

(58) Field of Classification Search
USPC ..... 42/70.01, 70.04, 70.06, 70.11
See application file for complete search history.

(56) References Cited

U.S. PATENT DOCUMENTS

| | | | | |
|---|---|---|---|---|
| 2,053,489 | A * | 9/1936 | Norman | 89/138 |
| 2,563,720 | A * | 8/1951 | Guisasola | 42/70.02 |
| 2,645,772 | A * | 7/1953 | Walker | 227/8 |
| 4,532,729 | A | 8/1985 | Von Muller | |
| 4,590,697 | A | 5/1986 | Ruger et al. | |
| 4,730,406 | A * | 3/1988 | Forbes et al. | 42/70.01 |
| 5,251,394 | A | 10/1993 | Bornancini | |
| 5,419,069 | A | 5/1995 | Mumbleau et al. | |
| 5,426,881 | A | 6/1995 | Ruger | |
| 5,467,550 | A | 11/1995 | Mumbleau | |
| 5,659,993 | A * | 8/1997 | Watson et al. | 42/70.04 |
| 5,784,818 | A * | 7/1998 | Otteson | 42/70.04 |
| 6,173,518 | B1 | 1/2001 | Oberst | |
| 6,212,812 | B1 | 4/2001 | Aigner | |
| 6,256,918 | B1 | 7/2001 | Szabo | |
| 6,260,298 | B1 | 7/2001 | Bubits | |
| 6,293,039 | B1 * | 9/2001 | Fuchs | 42/70.11 |
| 6,347,538 | B1 | 2/2002 | Doiron | |
| 6,389,728 | B1 | 5/2002 | Lundy | |
| 6,405,470 | B1 | 6/2002 | Strahan | |
| 6,438,886 | B1 | 8/2002 | Neumann | |
| 6,442,880 | B1 * | 9/2002 | Allan | 42/70.08 |
| 6,493,978 | B1 | 12/2002 | Perkins | |
| 6,601,331 | B2 | 8/2003 | Salvitti | |
| 6,615,527 | B1 | 9/2003 | Martin | |
| 6,817,131 | B1 | 11/2004 | Prechtl | |
| 6,952,895 | B1 | 10/2005 | Zonshine | |
| 7,155,856 | B1 | 1/2007 | Hylenski | |

(Continued)

FOREIGN PATENT DOCUMENTS

| | | |
|---|---|---|
| DE | 004009372 | 4/1989 |
| EP | 0973004 | 1/2000 |
| JP | 2003-042692 | 5/2001 |

OTHER PUBLICATIONS

Corresponding PCT/US 12/20328 Search Report and Written Opinion dated May 3, 2012.

*Primary Examiner* — Bret Hayes
(74) *Attorney, Agent, or Firm* — The Belles Group, P.C.

(57) ABSTRACT

A auto-loading firearm lockable manual safety mechanism operable to disable the firing control mechanism of the firearm. The firearm may include a frame, a pivotable hammer, and a trigger bar operably coupled to a pivotable trigger for cocking and releasing the hammer. In one embodiment, the trigger bar is movable between a firing position and standby position in which the firing mechanism is disabled. A rotary-operated camming member is provided that is engageable with the trigger bar. The camming member is operable to move the trigger bar between the firing and standby positions. In one embodiment, the camming member may be key-operated.

28 Claims, 9 Drawing Sheets

U.S. PATENT DOCUMENTS

| | | | |
|---|---|---|---|
| 7,204,051 | B2 | 4/2007 | Thomele et al. |
| 7,225,575 | B2 | 6/2007 | Kiesel, II et al. |
| 7,234,261 | B2 | 6/2007 | McGarry |
| 7,568,303 | B2 | 8/2009 | McClellan |
| 7,578,227 | B1 | 8/2009 | Jacob |
| 7,600,338 | B2 | 10/2009 | Geissele |
| 2001/0016999 | A1 | 8/2001 | Williams |
| 2002/0020100 | A1 | 2/2002 | Roca et al. |
| 2005/0229462 | A1 | 10/2005 | McGarry |
| 2005/0241470 | A1 | 11/2005 | Hochstrate et al. |
| 2007/0180984 | A1 | 8/2007 | Huther |
| 2008/0104874 | A1 | 5/2008 | Kiesel et al. |
| 2008/0216376 | A1 | 9/2008 | Pikielny |

* cited by examiner

LOCKABLE SAFETY FOR FIREARM

BACKGROUND OF THE INVENTION

The present invention generally relates to firearms, and more particularly to lockable manual safety mechanisms suitable for auto-loading pistols including those of a compact size.

Compact firearms, such as semiautomatic auto-loading pistols for concealed carry applications by law enforcement personnel and permitted civilians, present numerous design challenges due to the need to provide essentially the same functionality as full-size pistols, but in a relatively smaller physical package. Some compact pistols may have typical lengths between about 5-6 inches and weigh less than one pound in contrast to their longer and heavier full-size counterparts. Accordingly, it is desirable to minimize size and weight of these subcompact pistols to facilitate concealed carry by keeping the number of components required for a fully-functional pistol to a minimum without sacrificing functionality. Therefore, efficient use of limited available space which is at a premium is essential to providing lightweight and compact pistols suitable for concealed carry.

Some manually-operated lockable safety mechanisms employed in full size pistols may comprise numerous separate components and complexity which are not readily adaptable to smaller compact pistol formats where efficient use of limited available space is a prime design goal. Accordingly, a lockable manually operated mechanism suitable for such compact pistols is desired.

SUMMARY OF THE INVENTION

A user lockable manual safety mechanism is provided which is well suited for and efficiently utilizes the limited space available in an auto-loading compact pistol. According to one embodiment of the invention, the safety mechanism includes a rotatable eccentric camming member which operably engages and displaces the trigger bar in position so that the trigger bar is no longer operable to cock and release the hammer, thereby rendering the firing control mechanism of the pistol unable to discharge pistol when the trigger is pulled. The camming member is preferably disposed on a pin oriented transversely to the firearm frame.

According to one embodiment, an auto-loading firearm with manual safety mechanism includes a frame defining a longitudinal axis, a slide supported by the frame for axial movement thereon in a conventional manner, a hammer pivotably mounted on a pin supported by the frame, a trigger pivotably supported by the frame, and a trigger bar movably coupled to the trigger and operable to cock the hammer in response to pulling the trigger. The trigger bar is movable between a firing position in which the trigger bar is engageable with the hammer for discharging the firearm and a standby position in which the trigger bar is not engageable with the hammer to prevent discharging the firearm. A rotary-operated eccentric camming member is provided that is rotationally supported by the frame and movably engaged with the trigger bar. The trigger bar may be moved between the firing and standby positions via rotating the camming member, which concomitantly moves the trigger bar spatially closer to or farther away from the hammer respectively in alternating motions. The camming member is preferably disposed on a pin oriented transversely to the firearm frame, which in one embodiment may be the hammer pin.

According to another embodiment, an auto-loading firearm with manual safety mechanism includes a frame defining a longitudinal axis, a slide supported by the frame for axial movement thereon, a hammer pivotably mounted on a pin supported by the frame, a trigger pivotably supported by the frame, and a trigger bar operably coupled to the trigger and axially movable in the frame. The trigger bar includes a first operating surface engageable with a corresponding second operating surface on the hammer for cocking and releasing the hammer. The trigger bar is movable between a firing position in which the first operating surface is axially aligned to engage the second operating surface in response to pulling the trigger, and a standby position in which the first operating surface is not axially aligned with the second operating surface such that pulling the trigger will not cock the hammer. The firearm further includes a rotary-operated eccentric camming member rotationally disposed on the hammer pin which is movably engaged with the trigger bar. The trigger bar is movable between the firing and standby positions via rotating the camming member.

A method for disabling the firing control mechanism of a firearm is also provided. In one embodiment, the method includes the steps of: providing a firearm including a frame, hammer, and a trigger bar coupled to a trigger and movable therewith for cocking and releasing the hammer to discharge the firearm; axially aligning a first operating surface on the trigger bar with a corresponding second operating surface on the hammer, the trigger bar being in a firing position wherein pulling the trigger engages the first and second operating surfaces to cock and release the hammer; rotating an eccentric camming member having an eccentric portion; moving the first operating surface of the trigger bar out of axial alignment with the second operating surface by rotating the eccentric camming member, the trigger bar being in a standby position wherein pulling the trigger does not engage the first and second operating surfaces to prevent cocking and releasing the hammer.

BRIEF DESCRIPTION OF THE DRAWINGS

The features of the preferred embodiments will be described with reference to the following drawings where like elements are labeled similarly, and in which.

Figure 1:
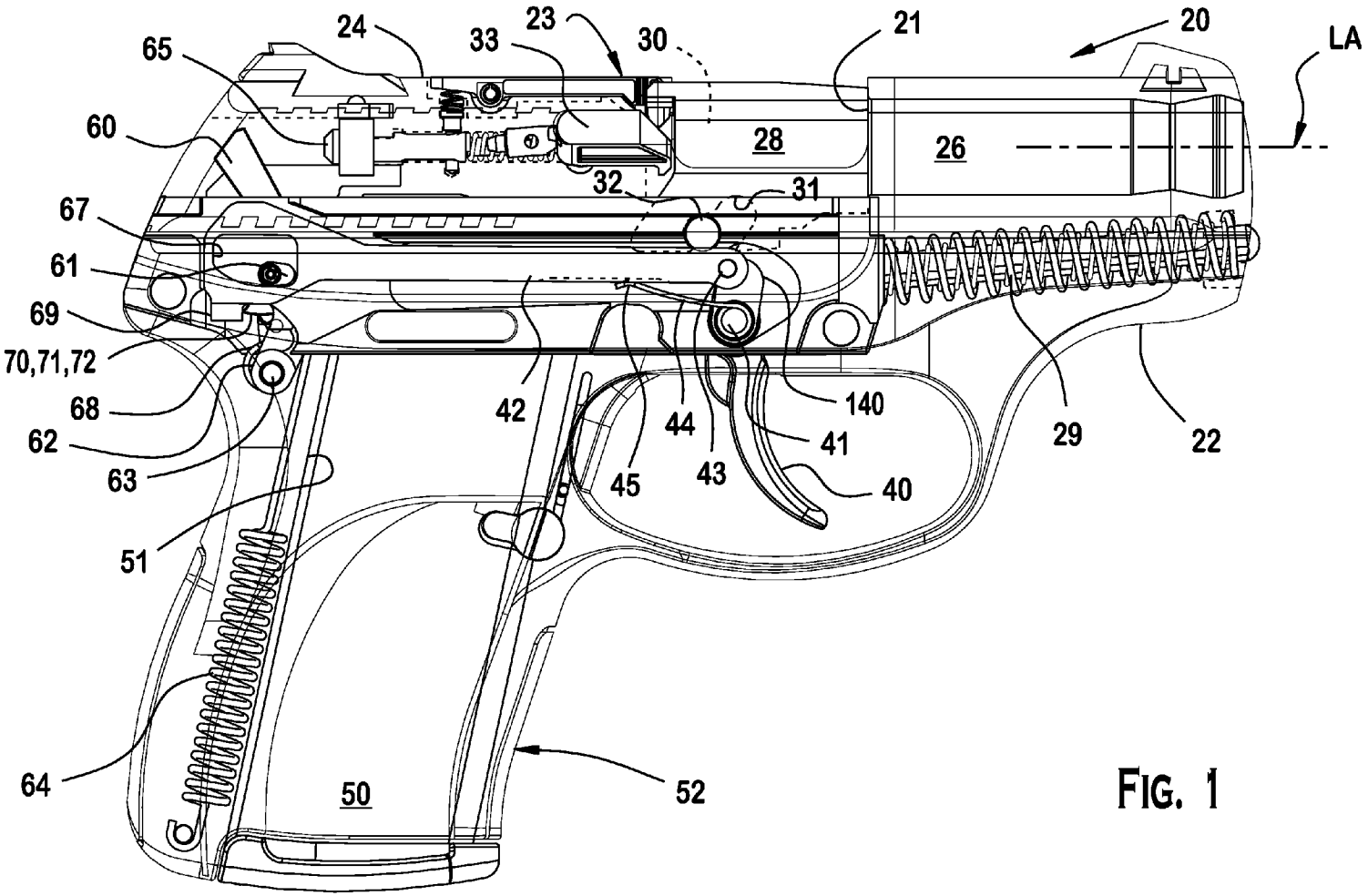
FIG. 1 is a right side view of one embodiment of a pistol showing the internal firing control mechanism.

All drawing shown herein are schematic and not to scale.

DESCRIPTION OF PREFERRED EMBODIMENTS

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

An exemplary auto-loading firearm incorporating one exemplary embodiment of a lockable manual safety mechanism according to principles of the present invention will now be described for convenience with reference to a semi-automatic pistol. The principles and features of the embodiments disclosed herein, however, may be used with equal benefit for other types of auto-loading firearms including compact or full-size pistols and rifles that include removable magazines. Accordingly, the invention is not limited in its applicability or scope to pistols alone as described herein.

Figure 2:
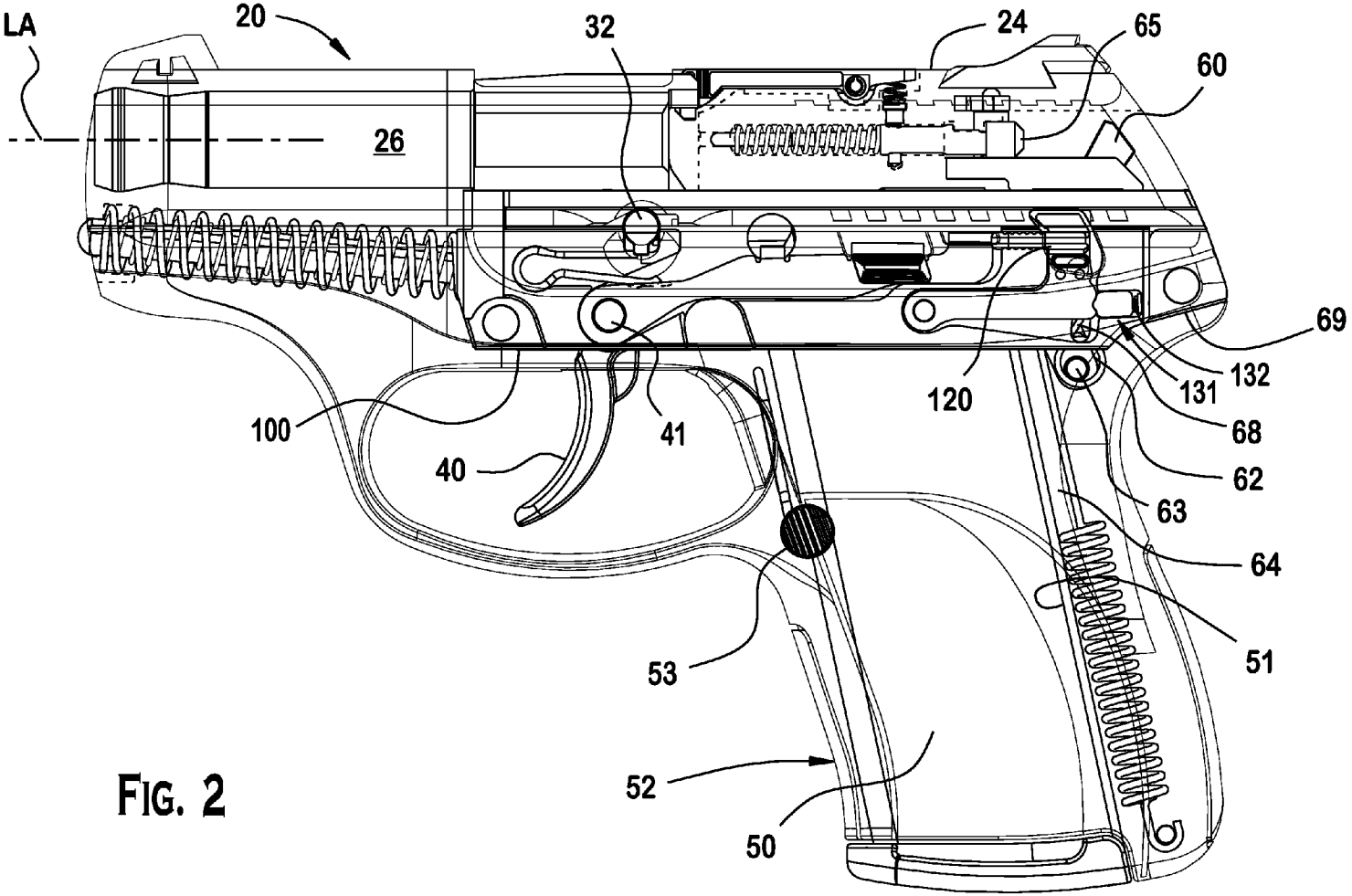
FIG. 2 is a left side view of the pistol of FIG. 1.
Figure 3:
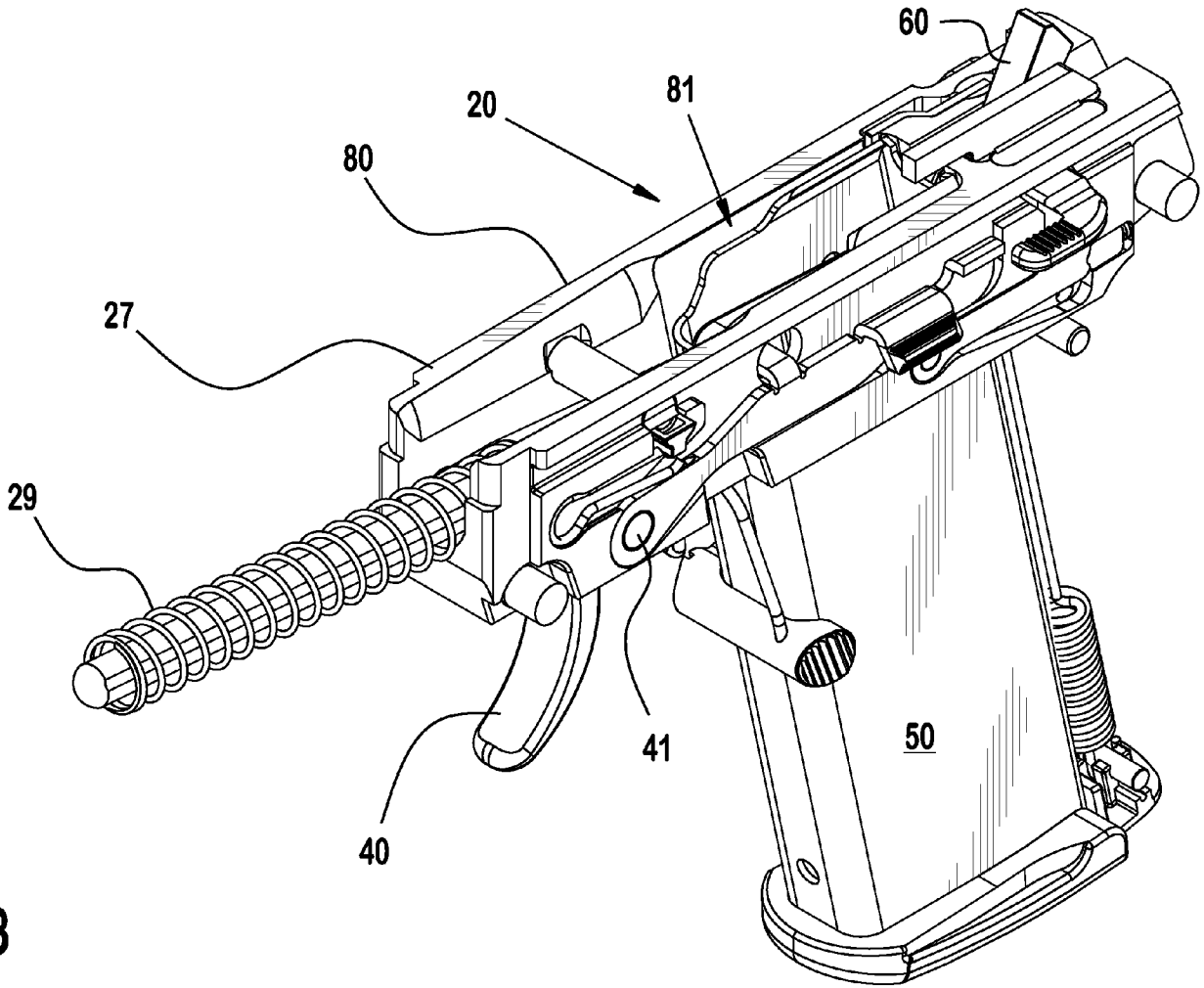
FIG. 3 is a left side perspective view of the firing control housing and mechanism of the pistol of FIG. 1 showing the magazine being inserted therein.
Figure 4:
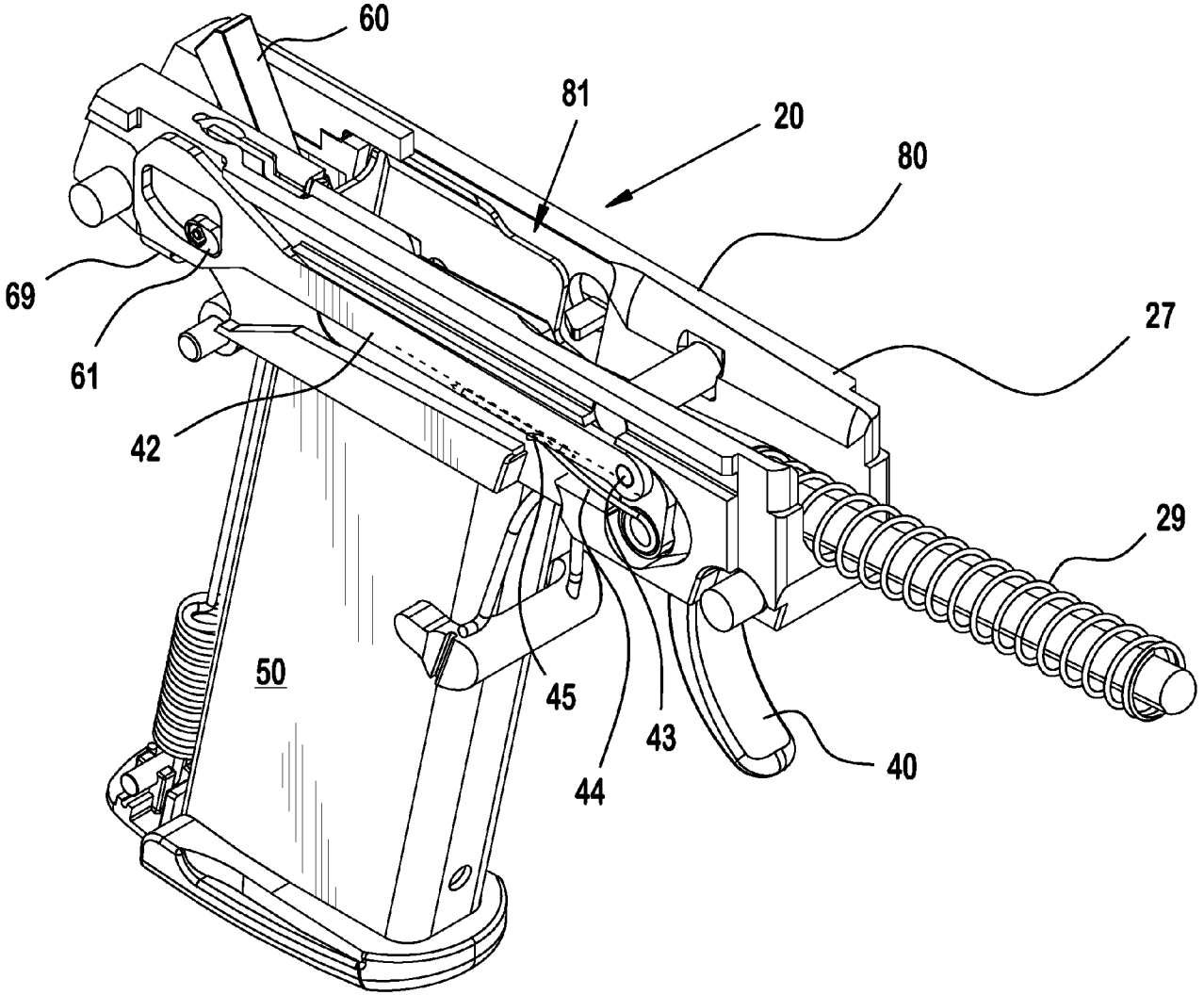
FIG. 4 is a right side perspective view of the firing control housing and mechanism of the pistol of FIG. 1 showing the magazine being inserted therein.

FIGS. 1 and 2 depict right and left side views of a pistol 20 respectively showing the firing control mechanism components with the frame and slide of the pistol shown superimposed in phantom view (in lighter solid lines) to better reveal these components and their relative positions as mounted therein. FIGS. 3 and 4 depict left and right side views of the firing control housing which supports the various firing control mechanism components, without the frame, slide, or barrel shown for clarity.

Referring now to FIGS. 1-4, pistol 20 includes a grip frame 22 and firing control housing 80 mounted therein that supports a plurality of firing control mechanism components, as further described herein. A slide 24 is slidably mounted on firing control housing 80 via a conventional support rail and slide groove system for axial reciprocating movement forwards and rearwards thereon. Recoil spring 29 is operably associated with slide 24 and acts to return the slide forward to the position shown in FIGS. 1 and 2 after discharging pistol 20. A magazine 50 is removably inserted into frame 22 and firing control housing 80 as further described herein. Magazine 50 is sized and configured for holding and dispensing a plurality of cartridges.

Pistol 20 further includes a barrel 26 that is movably disposed at least partially inside slide 24 and includes a rear chamber block 28 defining an open chamber 30 therein configured for receiving a cartridge. Breech area 23 is located at the rear of barrel 26 and chamber 30 for loading cartridges therein. Pistol 20 further defines a longitudinal axis LA having an axial direction and which is approximately centrically aligned with barrel 26 and slide 24 as shown in FIGS. 1 and 2. Barrel 26 is moveable rearwards with slide 24 on firing control housing 80 in a conventional manner due to recoil after discharging pistol 20. Barrel 26 includes a conventional cam track or slot 31 configured to engage a corresponding camming cross pin 32 mounted transversely in frame 22, more particularly in firing control housing 80 in some embodiments, for arresting the rearward movement of the barrel after discharging pistol 20 (not shown). Cross pin 32 limits and stops rearward movement of barrel 26 after traveling a relatively short distance rearwards upon discharging pistol 20. This allows slide 24 to continue moving rearwards alone, thereby opening breech area 23 so that a spent cartridge casing may extracted from chamber 30 by extractor 33 and ejected from pistol 20 through ejector port 21 in the slide. Thereafter, recoil spring returns slide 24 forward stripping a new cartridge from a magazine 50 and inserting the cartridge into chamber 30. Breech area 23 is re-closed and both slide 24 and barrel 26 are brought forward together to the ready-to-fire position shown in FIGS. 1 and 2.

With continuing reference to FIGS. 1-4, a firing control mechanism in one embodiment includes trigger assembly including trigger 40 pivotally mounted in frame 22 to firing control housing 80 via transverse pin 41, axially movable trigger bar 42 pivotally coupled to the trigger via transverse pin 43, hammer 60 pivotally mounted to firing control housing 80 via transverse pin 61, hammer stop 62 pivotally mounted to grip frame 22 via transverse pin 63 and engageable with the hammer, and axially movable spring-loaded firing pin 65 supported by slide 24 and positioned to be contacted by the hammer and driven forward to strike a chambered cartridge in a conventional manner. The combination of hammer 60 and firing pin 65 together define a means for striking a chambered cartridge to discharge firearm 20. Hammer spring 64, which may be a tension spring as shown or other suitable spring, connects to a lower portion of hammer 60 forward of pin 61 and biases the hammer forward towards firing pin 65. Trigger spring 44 may be a torsion spring as shown that is mounted about pin 41 and biases trigger 40 toward the fully forward ready-to-fire position shown in FIGS. 1-4. Trigger spring 44 further includes a rearwardly and laterally-extending leg 45 which acts on the underside of trigger bar 42 (best shown in FIGS. 4 & 5) to bias the trigger bar upwards towards engagement with hammer 60. In one embodiment, leg 45 may be disposed in an elongated slot or recess 145 formed in the underside of trigger bar 42 (see FIG. 5) to maintain positive engagement between spring 44 and the trigger bar.

With continuing reference to FIGS. 1-5, trigger bar 42 may be a generally flat and relatively thin plate-like structure having an elongated configuration. In one embodiment, the rear portion of trigger bar 42 may be enlarged and further defines an enlarged window 67 which receives a portion of hammer pin 61 therein. Window 67 interacts with hammer pin 61 to provide a vertical stop for limiting the upward position of trigger bar 42 under the vertically upward biasing force of trigger spring 44 via a lower portion and more specifically a lower surface 110 of window 67 engaging the hammer pin as shown in FIGS. 1 and 5-7 (further described herein).

To operably engage hammer 60 for cocking and releasing the hammer to discharge pistol 20, trigger bar 42 in one embodiment includes a laterally-extending portion such as trigger bar operating protrusion 69 as best shown in FIGS. 1 and 5-7. In one embodiment, trigger bar operating protrusion 69 may be configured as a generally flat flange projecting laterally inwards from trigger bar 42 when mounted in the pistol and firing control housing 80. Trigger bar protrusion 69 is configured and positioned to operably engage a portion of hammer 60. In one embodiment, trigger bar protrusion 69 includes a forward facing front operating surface 100 (see FIGS. 5-7) that is axially aligned to engage an operating portion 72 of hammer 60, which may be located on a lower portion 71 of hammer 60. Operating portion 72 may include a rearward facing rear operating surface 70 in a one embodiment which is engaged by front surface 100 on trigger bar protrusion 69 in response to pulling the trigger to cock and release hammer 60 for discharging pistol 20. In one embodiment, rear surface 70 may be concave in shape thereby forming an arcuate hook on operating portion 72 of hammer 60. This provides smooth movement and release of hammer 60 when operably engaged and cocked by trigger bar protrusion 69 of trigger bar 42.

Hammer stop 62 preferably is biased into engagement with hammer 60 by hammer stop spring 68 mounted about hammer stop pin 63 as shown in FIG. 1. When hammer 60 is cocked in the ready-to-fire position shown in FIGS. 1-4, hammer stop 62 preferably is engaged with hammer 60. Hammer stop 62 holds hammer 60 in the cocked position and prevents the hammer from being released in the absence of a trigger pull.

Operation of the firing control mechanism will now be described. Starting with pistol 20 in the ready-to-fire position shown in FIGS. 1-4, hammer 60 is shown cocked rearwards with an upper lever portion being aligned to strike but spaced apart from firing pin 65. Lateral trigger bar operating protrusion 69 of trigger bar 42 is axially aligned with rear surface 70 of hammer 60. Pulling trigger 40 causes a protruding upper portion or lever 140 of the trigger containing transverse pin 41 to rotate forwards about trigger pin 43 and similarly pulls trigger bar 42 axially forward. As trigger bar 42 moves forward, trigger bar protrusion 69 engages rear surface 70 of hammer 60 below pin 61 to rotate and cock the hammer rearwards. Trigger bar protrusion 69 continues forward to contact and disengage hammer stop 62 from hammer 60 and holds the hammer stop in a forward position while releasing the hammer. Hammer 60 rotates forward under the biasing force of hammer spring 64 and strikes the rear of firing pin 65, driving the firing pin forward to strike and a chambered cartridge and discharge pistol 20. After discharging pistol 20, the firing control mechanism returns to the ready-to-fire position shown in FIGS. 1-4 in a convention manner under the biasing force of recoil spring 29.

According to one aspect of the invention, a user-lockable manual safety mechanism is provided which disables the firing control mechanism of pistol 20. In one embodiment, the safety mechanism is configured and adapted to be operated by a key provided to the user. The safety mechanism will now be further described.

Referring to FIGS. 1 and 5-8, the safety mechanism includes a rotary-operated eccentric camming member 200 that is movable to engage and vertically displace trigger bar 42 so that the trigger bar cannot operate to cock and release hammer 60 in response to a trigger pull. In one embodiment, camming member 200 has a generally asymmetric shape including a generally planar and elongated flanged or lobed eccentric portion 209. Camming member 200 is preferably oblong in shape in an exemplary embodiment and may include rounded or arcuately shaped opposing ends configured for smoothly engaging and displacing trigger bar 42. In some embodiments, camming member 200 may be approximately oval, elliptical, or egg-shaped having two opposing long sides and two opposing short rounded sides on the ends. As further described herein, camming member 200 is operable to move trigger bar 42 between the firing and standby positions by rotatably changing the orientation of eccentric portion 209 about a fixed rotation axis RA with respect to grip frame 22.

Figure 8:
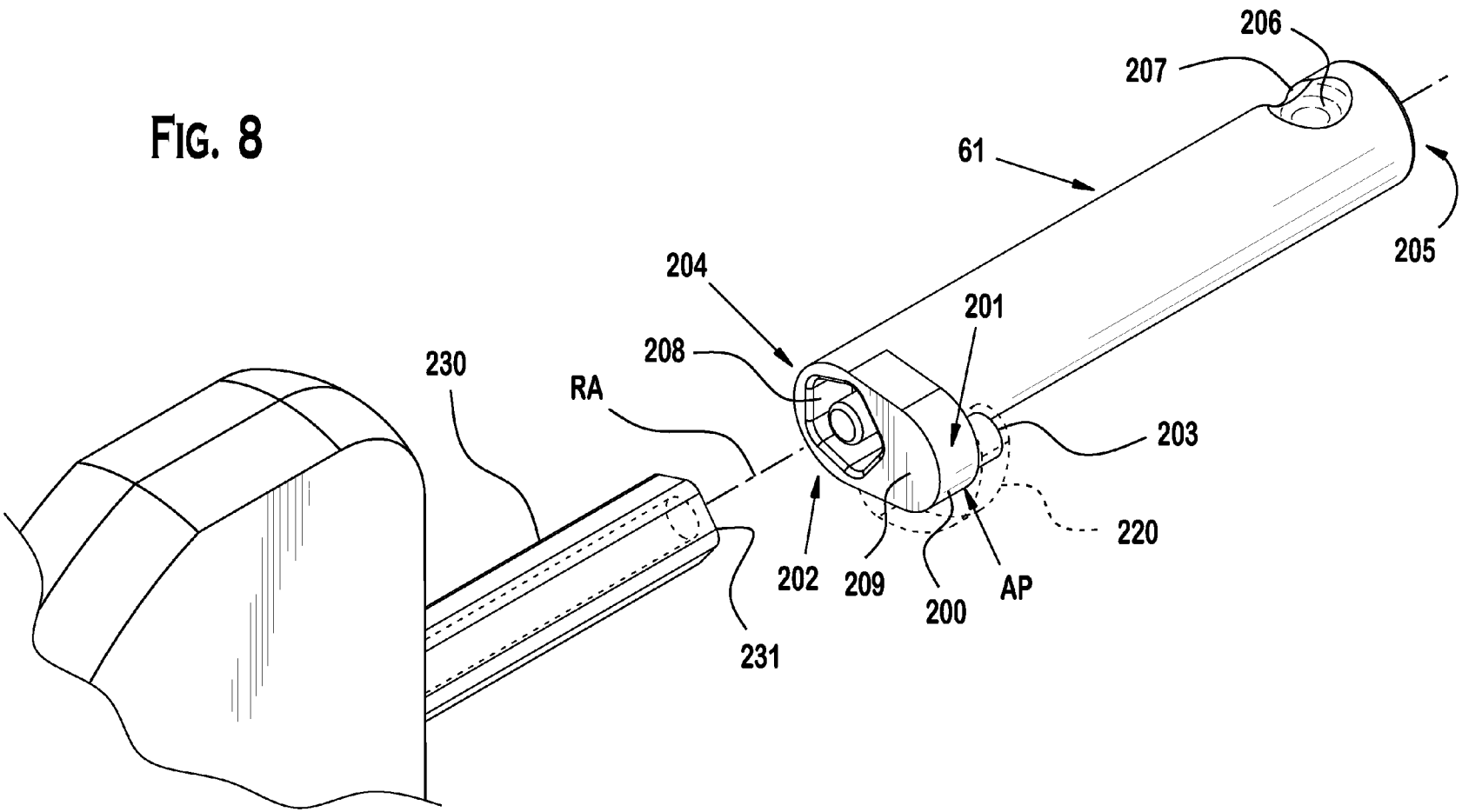
FIG. 8 is a perspective view of the hammer pin of the pistol of FIG. 1, which in the embodiment shown may include the key-operated camming member safety mechanism of FIGS. 5-7.

Camming member 200 is preferably disposed on an end of a pivot pin transversely mounted in and supported by frame 22 of pistol 20 proximate to window 67 disposed near the rear end of the trigger bar 42 as shown. In one exemplary embodiment, as best shown in FIG. 8, camming member 200 is preferably formed on one end 204 of hammer pin 61 to conserve valuable limited available space that may be available in pistol 20 which may be a compact design. In other embodiments contemplated, however, camming member 200 may be mounted on an independent and separate transversely mounted pin in frame 22. Camming member 200 may be a separate element attached to hammer pin 61 by any suitable means or may formed as an integral part of pin 61. Preferably, camming member 200 is rigidly affixed to or an integral part of hammer pin 61 so that the pin rotates together with the camming member. Hammer pin 61 is rotationally supported by a rear portion of grip frame 22, and more particularly in some embodiments by firing control housing 80, thereby allowing the camming member 200 to be rotated concomitantly with the hammer pin. It will be appreciated that in one embodiment, hammer pin 61 rotates independently of hammer 60 to enable the hammer to be cocked by the firing mechanism regardless of the position of the camming member 200.

With continuing reference to FIGS. 5-8, camming member 200 defines an arcuate camming surface 201 extending circumferentially around the entire peripheral edges of the camming member. Eccentric portion 209 defines an apex AP on camming surface 201 which is movable into and out of engagement with trigger bar 42. Apex AP is offset and located more distally from the rotational axis RA of camming member 200 (defined herein by the axial centerline of hammer pin 61, shown in FIG. 8) than any other part of the camming member. This arrangement permits camming member 200 to be located proximate to or touching trigger bar 42 such that rotation of the camming member is operable to displace the trigger bar as further described herein.

Figure 5:
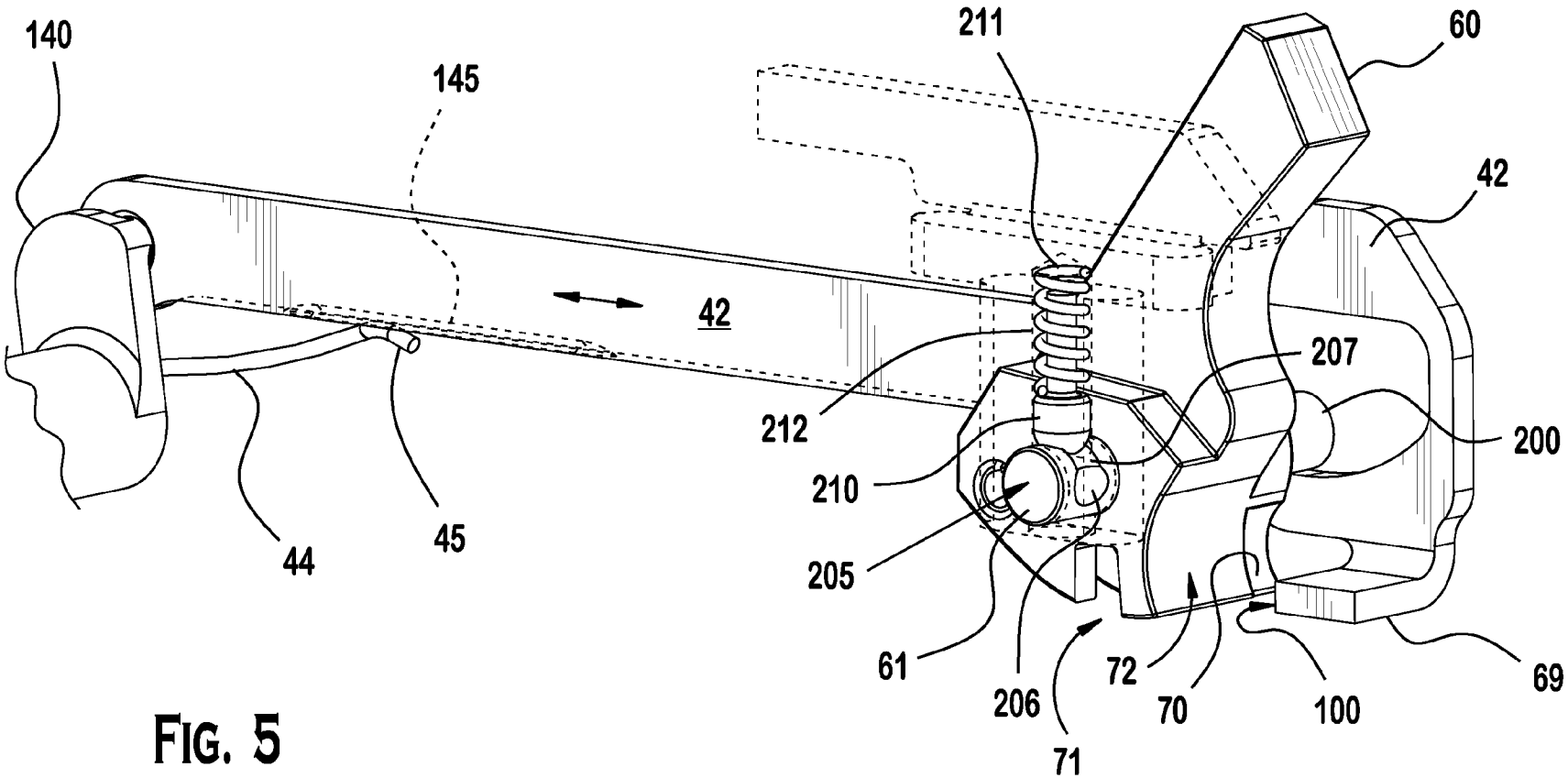
FIG. 5 is a partial left side perspective view of a rear portion of the firing control mechanism of the pistol of FIG. 1 showing the trigger bar, hammer, and a lockable manually operated eccentric camming member that provides a safety mechanism.
Figure 6:
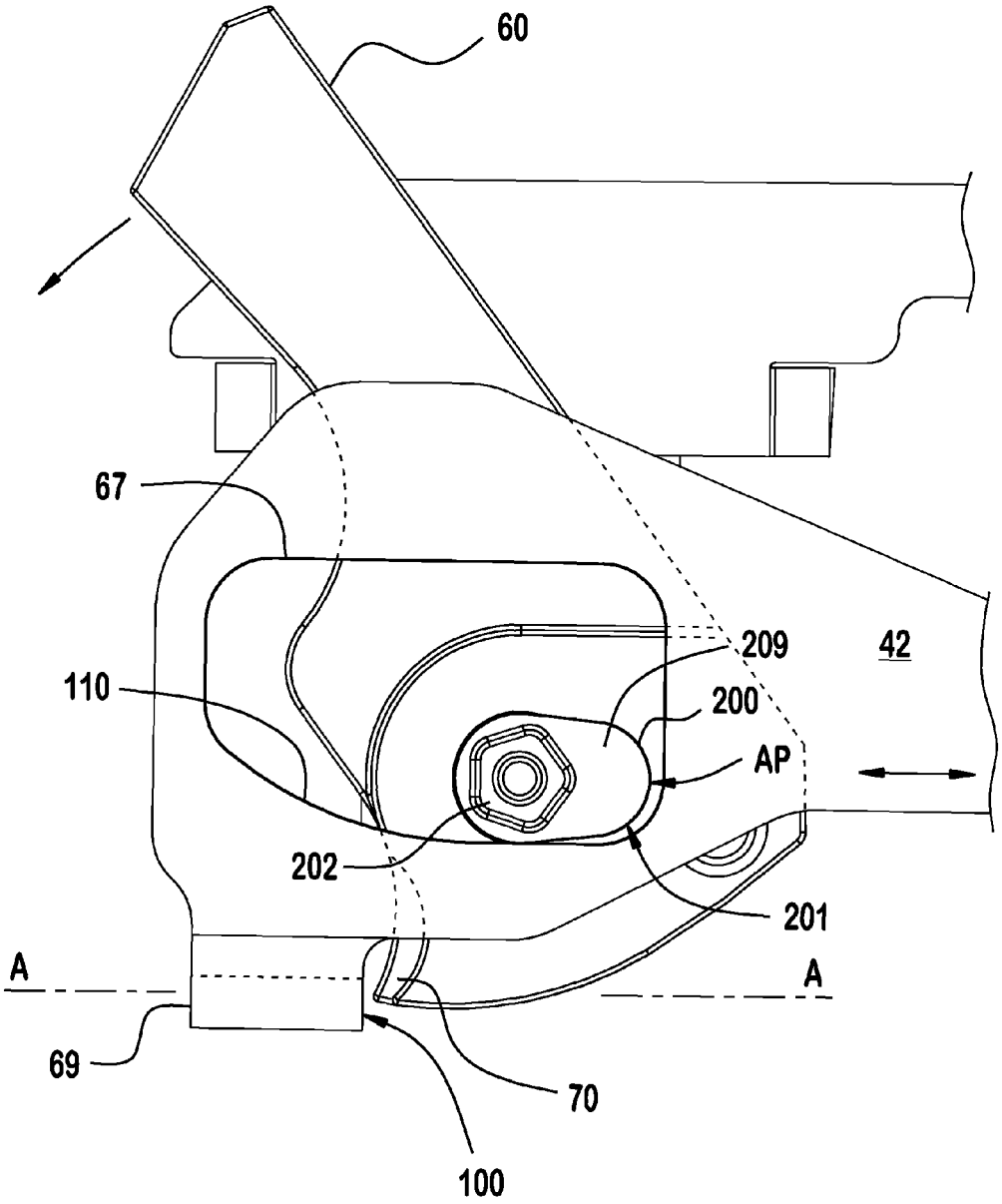
FIG. 6 is a right side view of the rear portion of the firing control mechanism shown in FIG. 5, with the camming member shown in a "safety off" position.
Figure 7:
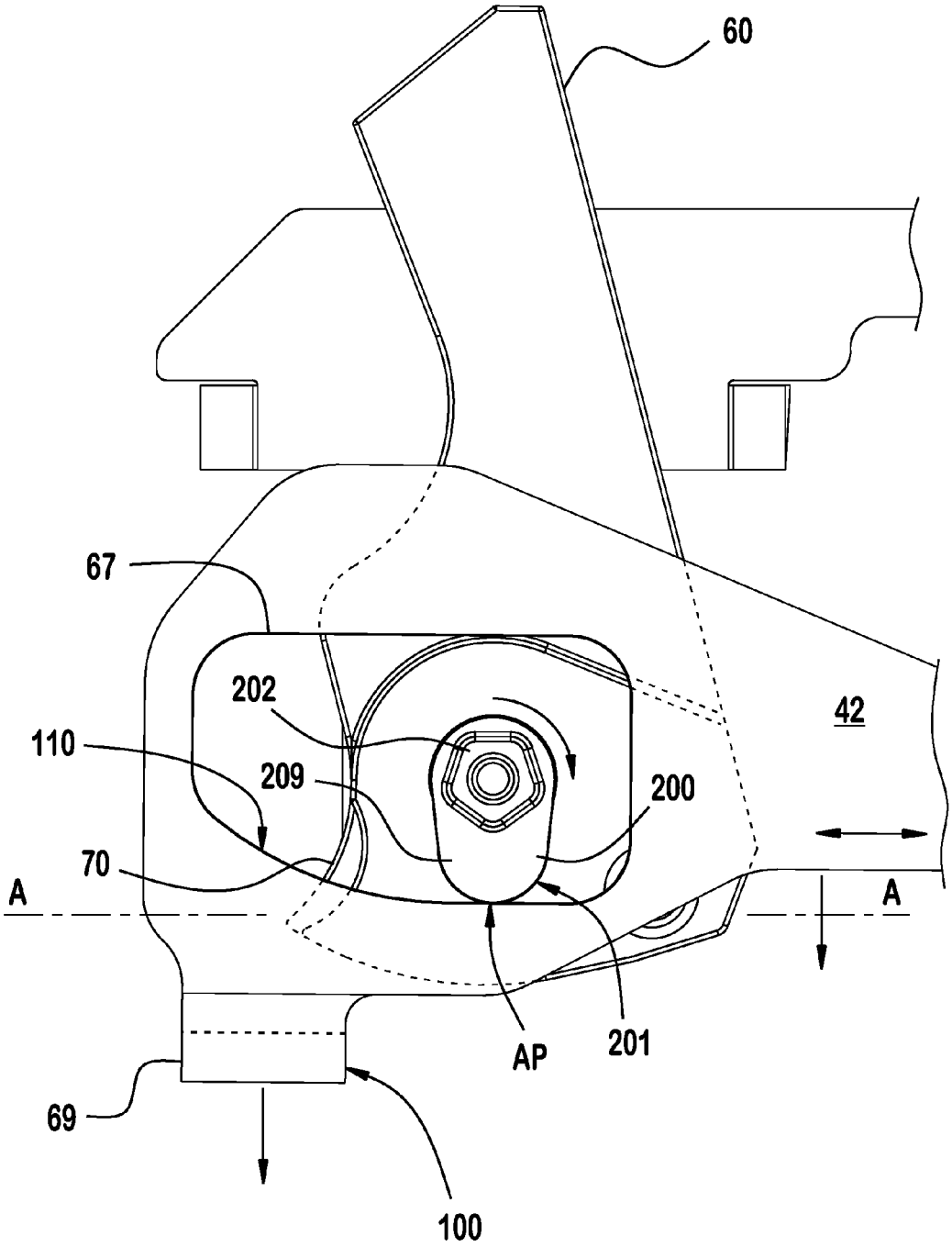
FIG. 7 is a right side view of the rear portion of the firing control mechanism shown in FIG. 5, with the camming member shown in a "safety on" position.

Referring to FIGS. 5-8, showing one possible embodiment, camming member 200 may engage lower surface 110 of window 67 formed in the rear portion of trigger bar 42. Trigger bar 42 is biased in a vertically upwards direction by rear leg 45 of trigger spring 44 (see also FIG. 1). As a result, different portions of camming surface 201 on camming member 200 may always be normally engaged with lower surface 110 in window 67 at all times during rotational operation of the camming member due to the upward biasing effect of spring 44. In other possible alternative embodiments where a separate means may be provided for limiting the maximum upward and vertical position of trigger bar 42, camming member 200 may be positioned and arranged such that only the eccentric portion 209 is rotationally movable into and out of engagement or contact with lower surface 110 of window 67. The former arrangement shown in FIGS. 6 and 7 is beneficial, however, since it minimizes the size or length of camming member 200 (measured from apex AP to a point directly opposition on the camming member) yet maximizes displacement of the trigger bar downwards when the camming member is operably rotated since the camming member is initially already engaged with the trigger bar.

It will be appreciated that in other possible embodiments, camming member 200 may be configured similarly to that shown in FIGS. 6-8 and operated in the same manner, but disposed on a separate pin rotatably mounted transversely in frame 22 instead of the hammer pin 61. In such embodiments, the camming member 200 may act on portions of trigger bar 42 other than within window 67 so long as the trigger bar may be displaced in position with respect to the hammer 60 to render the firing mechanism inoperable.

Figure 9:
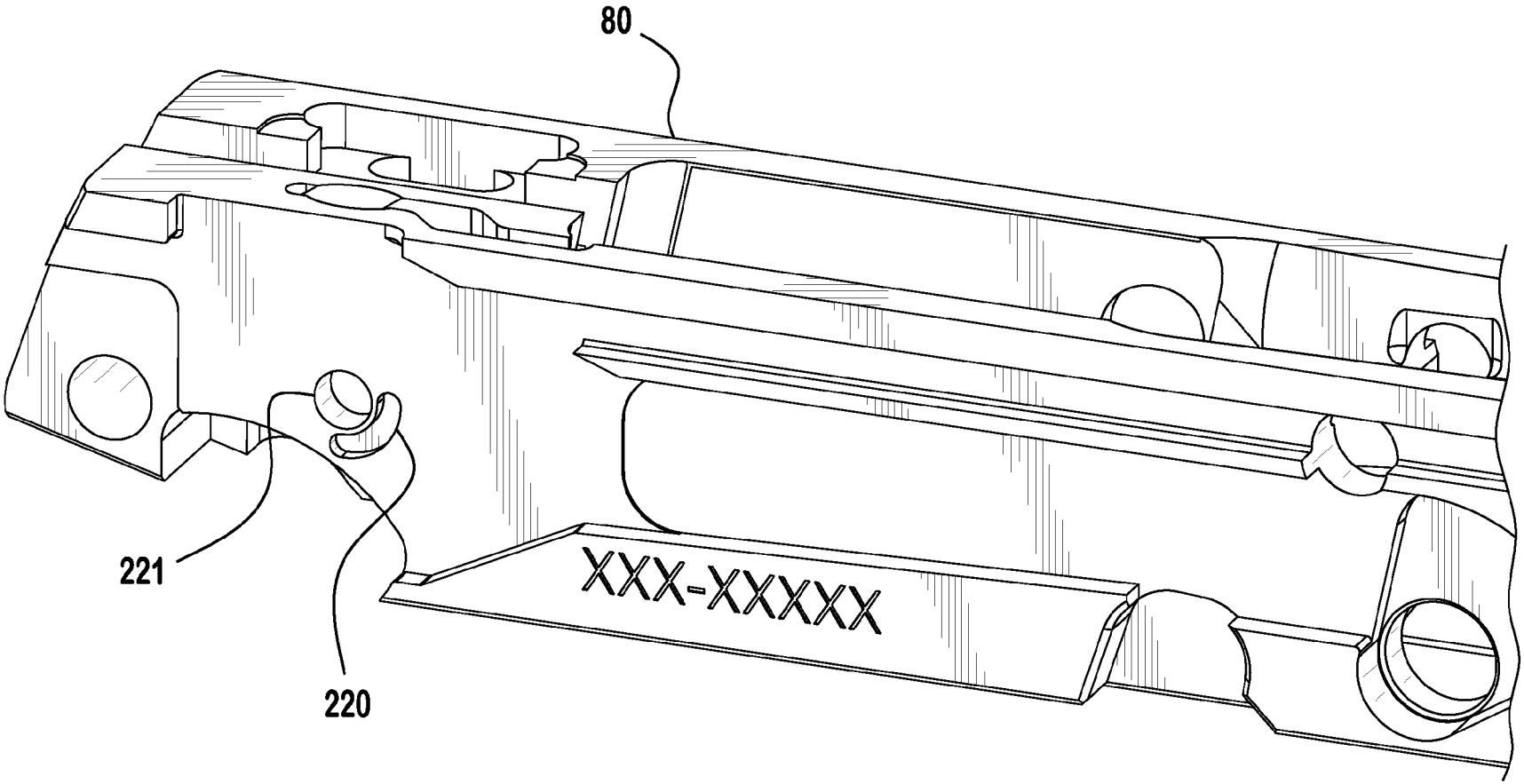
FIG. 9 is a perspective view of a rear portion of the firing control housing which rotationally supports the camming member safety mechanism of FIGS. 5-7.

Referring back now to FIG. 8, showing hammer pin 61 in detail, camming member 200 may include an inward projecting travel stop lug 203 which is received in a complementary configured arcuate recess 220 formed on firing control housing 80 proximate to hammer pin opening 221 as best shown in FIG. 9. Lug 203 limits the range of rotary movement possible of the camming member 200. In one embodiment, recess 220 extends circumferentially for a radial angle of approximately 90 degrees to provide camming member 200 with a ¼ turn operation between a "safety on" position and a "safety off" position, as further described herein.

Referring to FIGS. 5 and 8, end 205 of hammer pin 61 opposite end 204 containing camming member 200 may include a pair of circumferentially spaced apart detents 206 which are engaged by an axially reciprocating detent plunger 210. Detent plunger 210 is shown positioned in one of the detents 206 in FIG. 5 (i.e. upward facing detent), with the remaining detent (i.e. rearward facing) shown being unoccupied. FIG. 5 shows camming member 200 and hammer pin 61 in the "safety off" position also shown in FIG. 6 and further described herein. Detents 206 are joined via a concave shaped arcuate channel 207 formed in end 205. Channel 207 guides detent plunger 210 back and forth between each detent 206 during rotation of hammer pin 61 imparted by rotating camming member 200. Preferably, a detent spring 211 is provided in a cylindrical hole 212 disposed in firing control housing 80 or frame 22 which biases detent plunger 210 into engagement with detents 206 and channel 207. Preferably, detents 206 are circumferentially spaced 90 degrees apart in one embodiment which establishes two positive locking "safety on" and "safety off" positions for camming member 200. This preferably coincides with the circumferential 90 degree extent of travel stop lug 203 in firing control housing 80 described above to limit the radial angular travel of camming member 200 to the two operating positions established by the locations of detents 206.

Camming member 200 further may include a key-receiving recess 202 configured for engaging a complimentary configured removable user-operated key 230. In one possible embodiment as shown, recess 202 may include key-engaging surfaces 208 which may be arranged in a five-sided pentagon shape that can be operably engaged by similarly configured internal surfaces disposed in operating end 231 of key 230. Any suitable configuration of key-receiving recess 202 and key 230 may be used so long as the key is operable to engage and rotate camming member 200 and hammer pin 61. Receiving recess 202 is accessible by a suitably sized opening provided in grip frame 22 which can receive operating end 231 of key 230 there through.

Operation of the safety mechanism will now be described with primary reference to FIGS. 5-7. Referring initially to FIG. 6, trigger bar 42 is shown in the "firing position." Front operating surface 100 on trigger bar operating protrusion 69 of trigger bar 42 is axially aligned along operating axis A-A and engageable with rear operating surface 70 on hammer 60. Pulling trigger 40 will move trigger bar 42 forward as described herein, thereby cocking and releasing hammer 60 to discharge pistol 20. Camming member 200 is positioned in window 67 of trigger bar 42 and is in the "safety off" position in FIG. 6. Lobed eccentric portion 209 of camming member 200 is oriented horizontally and the camming member is not activated. A narrow side portion of camming member 200 below hammer pin 61 is engaged with lower surface 110 of window 67.

To actuate the manual safety mechanism, a user inserts key 230 into key-receiving recess 202 of camming member 200 and rotates the camming member a quarter turn or 90 degrees clockwise (as viewed in FIGS. 6 and 7) with the key. Lobed eccentric portion 209 of camming member 200 concomitantly rotates 90 degrees clockwise in a downward direction as shown in FIG. 7 (see directional arrow). Camming member 200 gradually moves into the "safety on" position shown in FIG. 7 during its rotation. Rotating the camming member 200 concomitantly gradually displaces or moves trigger bar 42 vertically downwards and away from hammer 60 (see directional arrows) against the upward biasing force of trigger spring 44 via increasing engagement of the portion of camming surface 201 disposed along the asymmetric lobed eccentric portion 209 with lower surface 110 in window 67 of trigger bar 42. When eccentric portion 209 is in a vertical position and camming surface 201 at apex AP is engaged with surface 110 of window 67, maximum vertical displacement of trigger bar 42 is reached. Trigger bar 42 is now in the "standby" position shown in FIG. 7 in which front operating surface 100 on trigger bar 42 is no longer axially aligned and engageable with rear operating surface 70 on hammer 60 along operating axis A-A associated with the hammer. Pulling trigger 40 will not actuate the firing mechanism because of the misalignment of trigger bar operating protrusion 69 with operating portion 72 of hammer 60. Therefore, hammer 60 cannot be cocked by pulling the trigger 40 since there is no engagement between the trigger bar and hammer. The user may now withdraw key 230 from pistol 20 with the disabled firing mechanism.

It should be noted that as the camming member 200 is moved from the "safety off" position of FIG. 6 to the "safety on" position of FIG. 7, detent plunger 210 moves from engagement with the upward facing detent 206 shown in FIG. 5 to the open rearward facing detent 206 shown. This provide positive positioning of the camming member 200 and retains the camming member in the intended operational position unless moved via key 230. In addition, travel stop lug 203 (see FIG. 8) moves from the top of arcuate slot 220 to the bottom of slot, thereby controlling and limiting the maximum rotation of camming member 200 between the "safety on" and "safety off" positions.

To return the firing control mechanism and trigger bar 42 to the "firing" position shown in FIG. 6, the foregoing process is reversed. The user reinserts key 230 into key-receiving recess 202 of camming member 200, and rotates the camming member and hammer pin 61 in a counterclockwise direction (as viewed in FIGS. 6-7). Camming member will now be returned to position shown in FIG. 6 and trigger bar 42 is returned to the "firing" position already described herein. The firing control mechanism is now fully operational again to discharge pistol 20.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An auto-loading firearm with manual safety mechanism comprising:

a frame defining a longitudinal axis;

a slide supported by the frame for axial movement thereon;

a hammer pivotably mounted on a rotatable hammer pin supported by the frame;

a trigger pivotably supported by the frame;

a trigger bar movably coupled to the trigger and operable to cock the hammer in response to pulling the trigger, the trigger bar being movable between a firing position in which the trigger bar is engageable with the hammer for discharging the firearm and a standby position in which the trigger bar is not engageable with the hammer to prevent discharging the firearm; and a manual safety comprising a rotary-operated eccentric camming member fixedly disposed on the hammer pin and being rotatable via rotating the hammer pin, the camming member movably engaged with the trigger bar, the camming member extending and being elongated in a direction perpendicular to the hammer pin, the trigger bar being moved between the firing and standby positions via rotating the camming member;

wherein manually rotating the hammer pin concomitantly rotates the eccentric camming member which engages and displaces the trigger bar downwards away from the hammer into the standby position.

2. The firearm of claim 1, wherein the trigger bar moves vertically between the firing and standby positions.

3. The firearm of claim 1, wherein the eccentric camming member includes an eccentric portion engageable with the trigger bar, wherein changing the orientation of the eccentric portion by rotating the camming member moves the trigger bar between the firing and standby positions.

4. The firearm of claim 3, wherein the eccentric portion defines an arcuately shaped camming surface having an apex, the apex being movable into and out of engagement with the trigger bar between the standby and firing positions.

5. The firearm of claim 3, wherein the eccentric camming member is movable between a first position in which the eccentric portion is oriented horizontally and a second position in which the eccentric portion is oriented vertically.

6. The firearm of claim 5, wherein the trigger bar is in the firing position when the eccentric camming member is in the first position, and the trigger bar is in the standby position when the camming member is in the second position.

7. The firearm of claim 1, wherein the eccentric camming member engages a surface defined by a window in a rear portion of the trigger bar.

8. The firearm of claim 1, wherein the trigger bar is biased towards the firing position by a spring.

9. The firearm of claim 1, wherein the eccentric camming member is rotatable via a removable user-operated key engageable with a complementary shaped recess in the camming member.

10. The firearm of claim 1, wherein the camming member maintains surface contact with trigger bar when in both the firing position and standby position.

11. The firearm of claim 10, wherein the trigger bar includes a window having a lower surface engaged with the camming member, the lower surface engaging the camming member in both the firing position and standby position.

12. The firearm of claim 1, wherein the camming member has an oblong shape and a camming surface disposed on a portion of the camming member which projects beyond a diameter of the hammer pin.

13. The firearm of claim 1, wherein the hammer pin defines a common rotational axis for the hammer and eccentric camming member.

14. An auto-loading firearm with manual safety mechanism comprising:

a frame defining a longitudinal axis;

a slide supported by the frame for axial movement thereon;

a hammer pivotably mounted on a rotatable hammer in supported by the frame;

a trigger pivotably supported by the frame;

a trigger bar operably coupled to the trigger and axially movable in the frame, the trigger bar including a first operating surface engageable with a corresponding second operating surface on the hammer for cocking and releasing the hammer;

the trigger bar being movable between a firing position in which the first operating surface is axially aligned to engage the second operating, surface in response to pulling the trigger and a standby position in which the first operating, surface is not axially aligned with the second operating surface such that pulling the trigger will not cock the hammer; and a manual safety comprising a rotary-operated eccentric camming member fixedly disposed on the hammer pin and being rotatable via rotating the hammer pin, the camming member movably engaged with the trigger bar, the camming member extending and being elongated in a direction perpendicular to the hammer pin, the trigger bar being moved between the firing and standby positions via rotating the camming member;

wherein manually rotating the hammer pin concomitantly rotates the eccentric camming member which engages and displaces the trigger bar downwards away from the hammer into the standby position.

15. The firearm of claim 14, wherein rotating the eccentric camming member in opposing directions moves the trigger bar back and forth between the firing and standby positions.

16. The firearm of claim 14, wherein the eccentric camming member includes an eccentric portion engageable with the trigger bar, wherein changing the orientation of the eccentric portion by rotating the camming member moves the trigger bar between the firing and standby positions.

17. The firearm of claim 16, wherein the eccentric camming member is movable between a first position in which the eccentric portion is oriented horizontally when the trigger bar is in the firing, position, and a second position in which the eccentric portion is oriented vertically when the trigger bar is in the standby position.

18. The firearm of claim 17, further comprising a detent plunger and a pair of detents disposed on the hammer pin operable to maintain the eccentric camming member in the first and second positions.

19. The firearm of claim 17, wherein the eccentric camming member includes a travel stop lug engageable with a corresponding recess in the frame for limiting the rotation of the camming member.

20. The firearm of claim 14, wherein the eccentric camming member engages a surface defined by a window in a rear portion of the trigger bar.

21. The firearm of claim 14, wherein the trigger bar is biased towards the firing, position by a spring.

22. The firearm of claim 14, wherein the trigger bar moves vertically between the firing and standby positions.

23. The firearm of claim 14, wherein the camming member maintains surface contact with trigger bar when in both the firing position and standby position.

24. A method for disabling the firing control mechanism of a firearm, the method comprising:

providing a firearm including a frame, hammer mounted in the frame via a rotatable hammer pin including an elongated eccentric camming member fixedly disposed on the pin, and a trigger bar coupled to a trigger and movable therewith for cocking and releasing the hammer to discharge the firearm;

axially aligning a first operating surface on the trigger bar with a corresponding second operating surface on the hammer, the trigger bar being in a firing position wherein pulling the trigger engages the first and second operating surfaces to cock and release the hammer;

rotating the eccentric camming member having an eccentric portion by manually rotating the hammer pin;

moving the first operating surface of the trigger bar out of axial alignment with the second operating surface by rotating the eccentric camming member with the hammer pin, the trigger bar being in a standby position wherein pulling the trigger does not engage the first and second operating surfaces to prevent cocking and releasing, the hammer.

25. The method of claim 24, wherein the rotating step includes turning the eccentric camming member with a key removably engageable with the hammer pin and camming member.

26. The method of claim 24, wherein the eccentric camming member is rotatable between an "on" position in which the eccentric, portion is oriented horizontally when the trigger bar is in the firing position, and an "off" position in which the eccentric portion is oriented vertically when the trigger bar is in the standby position.

27. The method of claim 24, wherein during the moving step, the eccentric portion of the eccentric ramming member engages and displaces the trigger bar downwards in position.

28. The method of claim 24, wherein the moving step further includes a step of simultaneously positioning a detent plunger engaged with a first detent on the pin to engage a second detent on the pin, the position of each detent coinciding with the firing and standby positions of the trigger bar.

* * * * *

UNITED STATES PATENT AND TRADEMARK OFFICE

CERTIFICATE OF CORRECTION

PATENT NO. : 8,464,455 B2
APPLICATION NO. : 12/986282
DATED : June 18, 2013
INVENTOR(S) : Robert A. Kallio It is certified that error appears in the above-identified patent and that said Letters Patent is hereby corrected as shown below:

In the Claims

Column 10, line 33, the text "in" should be changed to --pin--
Column 10, line 43, delete the punctuation ","
Column 10, line 45, delete the punctuation ","
Column 11, line 4, delete the punctuation ","
Column 11, line 20, delete the punctuation ";"
Column 12, line 14, delete the punctuation ","
Column 12, line 21, delete the punctuation ","
Column 12, line 26, the text "ramming" should be changed to --camming--

Signed and Sealed this
First Day of April, 2014

Michelle K. Lee

Michelle K. Lee
*Deputy Director of the United States Patent and Trademark Office*